US008622204B2

(12) United States Patent
Tseng

(10) Patent No.: US 8,622,204 B2
(45) Date of Patent: Jan. 7, 2014

(54) JEWELRY DISPLAY STAND

(76) Inventor: Louis K. Tseng, Diamond Bar, CA (US)

( * ) Notice: Subject to any disclaimer, the term of this patent is extended or adjusted under 35 U.S.C. 154(b) by 185 days.

(21) Appl. No.: 13/291,631

(22) Filed: Nov. 8, 2011

(65) Prior Publication Data

US 2013/0111951 A1 May 9, 2013

(51) Int. Cl.
*A45C 11/04* (2006.01)
*A47F 7/02* (2006.01)

(52) U.S. Cl.
USPC ..... 206/6.1; 211/85.2; D6/672

(58) Field of Classification Search
USPC ..... 248/441.1, 460, 176.1, 309.1, 469, 476, 248/479, 116; 211/85.2, 13.1, 85.26, 133.1, 211/168; 206/495, 495.5, 6.1, 566, 751, 206/759, 458, 736, 755; D6/672, 10, 316, D6/494; 63/1.11, 13
See application file for complete search history.

(56) References Cited

U.S. PATENT DOCUMENTS

| | | | | |
|---|---|---|---|---|
| 1,615,275 | A * | 1/1927 | Horn | 248/451 |
| 2,080,119 | A | 5/1937 | Duell | |
| 4,371,077 | A * | 2/1983 | Solitt et al. | 206/759 |
| 4,732,269 | A * | 3/1988 | Roy | 206/751 |
| 6,205,688 | B1 | 3/2001 | Grosser-Samuels | |
| D445,275 | S | 7/2001 | Tringali | |
| 6,471,077 | B1 * | 10/2002 | Johnson | 211/85.2 |
| 6,758,330 | B1 * | 7/2004 | Chudada | 206/6.1 |
| D660,049 | S * | 5/2012 | Tseng | D6/449 |
| 2005/0183983 | A1 | 8/2005 | Ovadia | |
| 2006/0201824 | A1 | 9/2006 | Mobley | |
| 2013/0111951 | A1 * | 5/2013 | Tseng | 63/1.11 |

FOREIGN PATENT DOCUMENTS

| | | | |
|---|---|---|---|
| JP | 2002102028 | A | 4/2002 |
| JP | 2005058318 | A | 3/2005 |
| KR | 20090006299 | | 6/2009 |

OTHER PUBLICATIONS

"Necklace Pad w/Easel Display, Black Velvet" Allen Display, http://www.allendisplay.cotn/Necklace-Pad-w-Easel-Display-Black-Velvet, accessed Jul. 27, 2011.

"Darice Jewelry Display Necklace Stand 7.25 Flocked Black" http://wwvv.google.com/products/catalog?g=jewelry+display+stands&hl—en&prmd=ivns&bav=on.2,or.r_gc.rpw.&biw=1366&bih=587&wrapid=tlif131177682165610&um=1&ie=UTF8&tbm=shop&cid=4304048519916223038&sa=X&ei-OSAwTs_IFcm_gQeivl,XmCg&ved=OCJUBEPMCMAg#, accessed Jul. 27, 2011.

* cited by examiner

*Primary Examiner* — Tan Le
(74) *Attorney, Agent, or Firm* — Greenberg Traurig, LLP

(57) ABSTRACT

A jewelry display stand having a main body portion simulating the neck and upper torso of a person. A necklace can be draped over the front of the main body portion, which is hollow on the interior, so that the end of the necklace can either be inserted into an opening in the back of the main body portion communicating with the interior thereof, or hooked under a tab on the back of the main body portion. A retractable panel is provided on the back of the main body portion for supporting the same in an upright position.

11 Claims, 9 Drawing Sheets

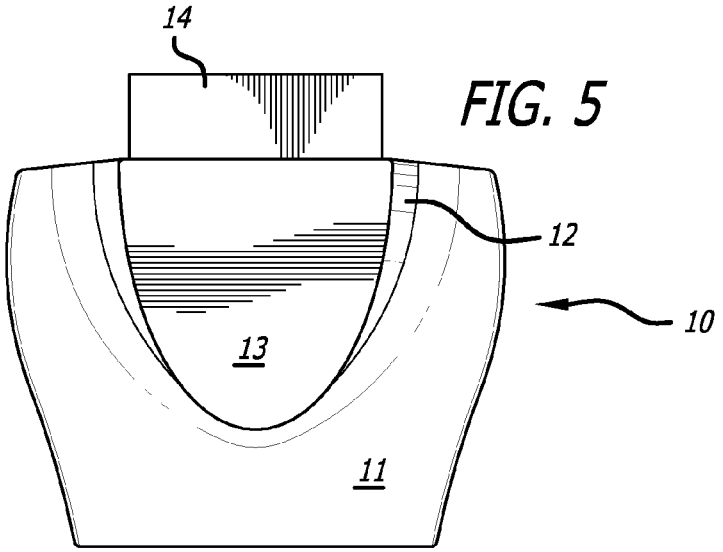
FIG. 5
FIG. 6
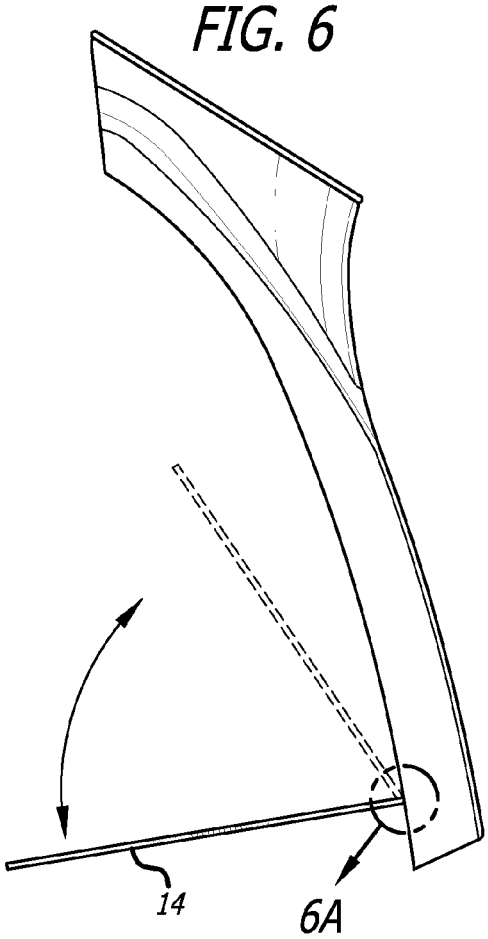

JEWELRY DISPLAY STAND

RELATED APPLICATION

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not Applicable.

THE NAMES OF THE PARTIES TO A JOINT RESEARCH AGREEMENT

Not applicable.

BACKGROUND OF THE INVENTION

Field

The invention relates to jewelry display stands; and, more particularly, to a light-weight, easily transportable display stand for displaying jewelry, such as a necklace, in a pleasing manner.

DESCRIPTION OF RELATED ART INCLUDING INFORMATION DISCLOSED UNDER 37 C.F.R. 1.97 AND 1.98

One of the most important factors in the commercial marketing of ornamental jewelry is to present the ornamental jewelry in a manner that is pleasing, attracts potential buyers' attention, and provide potential buyers with a perception of how the jewelry will be displayed when it is worn by a person. To accomplish these goals, three dimensional jewelry display stands shaped as a particular portion of the human contour where the subject jewelry will be worn, such as the neck and shoulder area, or human hands, are widely used to display jewelry to potential buyers.

For jewelry merchants, one problem they often encounter is the size and weight of such three dimensional jewelry display stands. There is a need for jewelry display devices that can display an item of jewelry, such as a necklace, in an attractive, aesthetically pleasing manner by realistically simulating how the jewelry will appear when worn.

BRIEF SUMMARY OF THE INVENTION

It is an object of this invention to provide a jewelry display stand that is lightweight, easily transportable and can display a piece of jewelry, such as a necklace, in a manner simulating how the necklace will appear when worn.

It is a further object of this invention to provide such a stand that can be quickly formed into a self supporting stand and provides a place for storing the chain of the necklace when displayed on the stand.

These and other objects are preferably accomplished by providing a display stand of a lightweight material, such as plastic, having a support on the rear that is foldable from a first stored position flush with the back of the stand to a second flat position extending away from the bottom of the stand for supporting the stand on a supporting surface. The front of the display stand simulates the upper torso of a person and the rear of the display stand has a flap for either hooking thereon excess chain of the necklace being displayed or storing the same in an opening in the stand.

BRIEF DESCRIPTION OF THE SEVERAL VIEWS OF THE DRAWINGS

The above-mentioned features and objects of the present disclosure will become more apparent with reference to the following description taken in conjunction with the accompanying drawings wherein like reference numerals denote like elements and in which:

FIG. 5 is a top plan view of the stand of FIGS. 1 to 4;

FIG. 6 is a side view of the stand of FIGS. 1 to 5 illustrating opening and closing of the rear support panel.

DETAILED DESCRIPTION OF THE INVENTION

Figure 1:
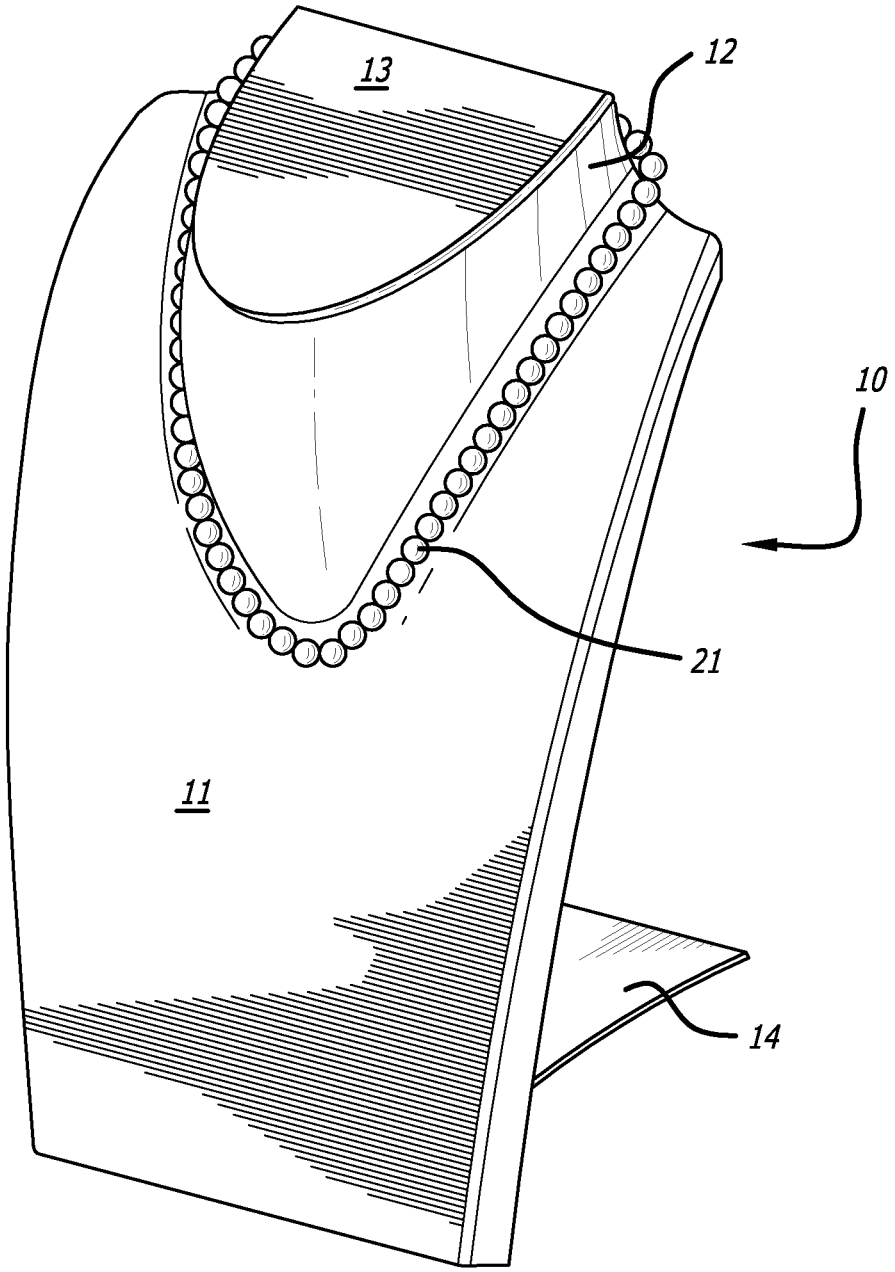
FIG. 1 is a front perspective view of the stand of the invention.

Referring now to FIG. 1 of the drawing, a display stand 10 is shown having a main body portion 11 contoured as the upper torso of a person. A neck portion 12 closes off the upper end of body portion 11 and thus simulates the neck of a person (see also FIG. 3). A flat area 13 closes off the top of stand 10 (FIG. 1).

As seen in FIGS. 1, 2A to 2D, and 6, a support panel 14 extends from the bottom of stand 10 and is hinged thereto at hinge 15. Panel 14 is adapted to fold up into a like configured cavity 16, as indicated by the arrow in FIG. 2A and can be pulled down by one's finger inserted into a semi-circular depression 17 (FIG. 2D) in the rear wall 18 of body portion 11. As seen in FIG. 6, panel 14, when in support position, may be angled from the horizontal as shown.

The body portion of display stand 10 is hollow having an opening 19 (FIGS. 2A to 2D and 4A to 4B) communicating the back of display stand 10 with the interior thereof. A tab 20 is integral with rear wall 18 and extends over the opening 19 as shown.

Figure 2A:
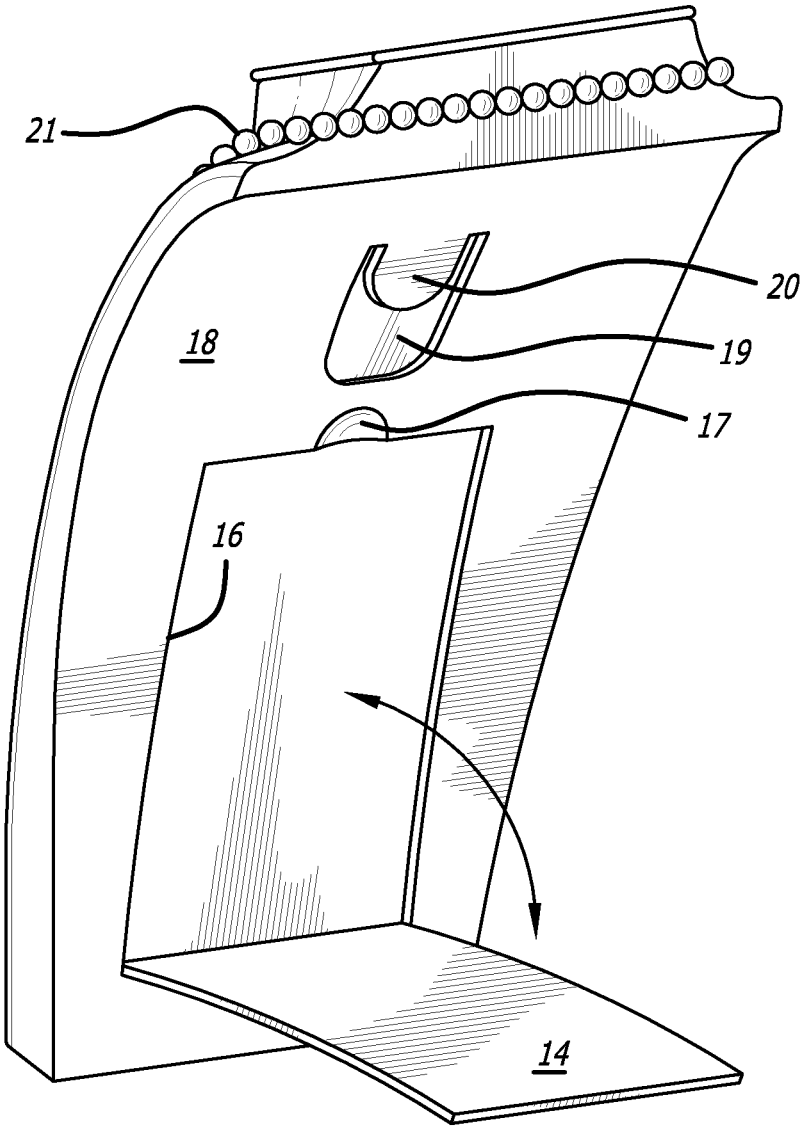
FIG. 2A is a rear perspective view of the stand of the invention.
Figure 2B:
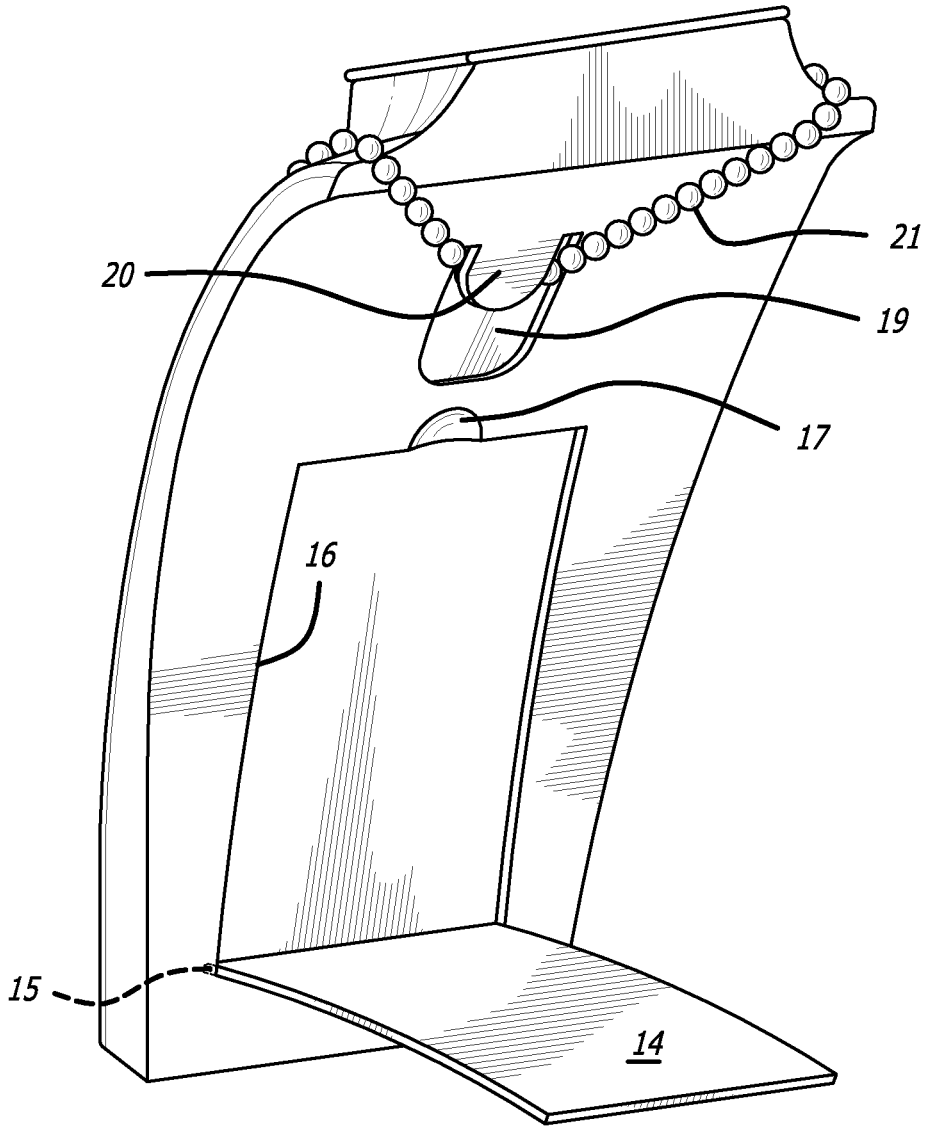
FIGS. 2B and 2C are views similar to FIG. 2A illustrating alternate features of the invention.
Figure 2C:
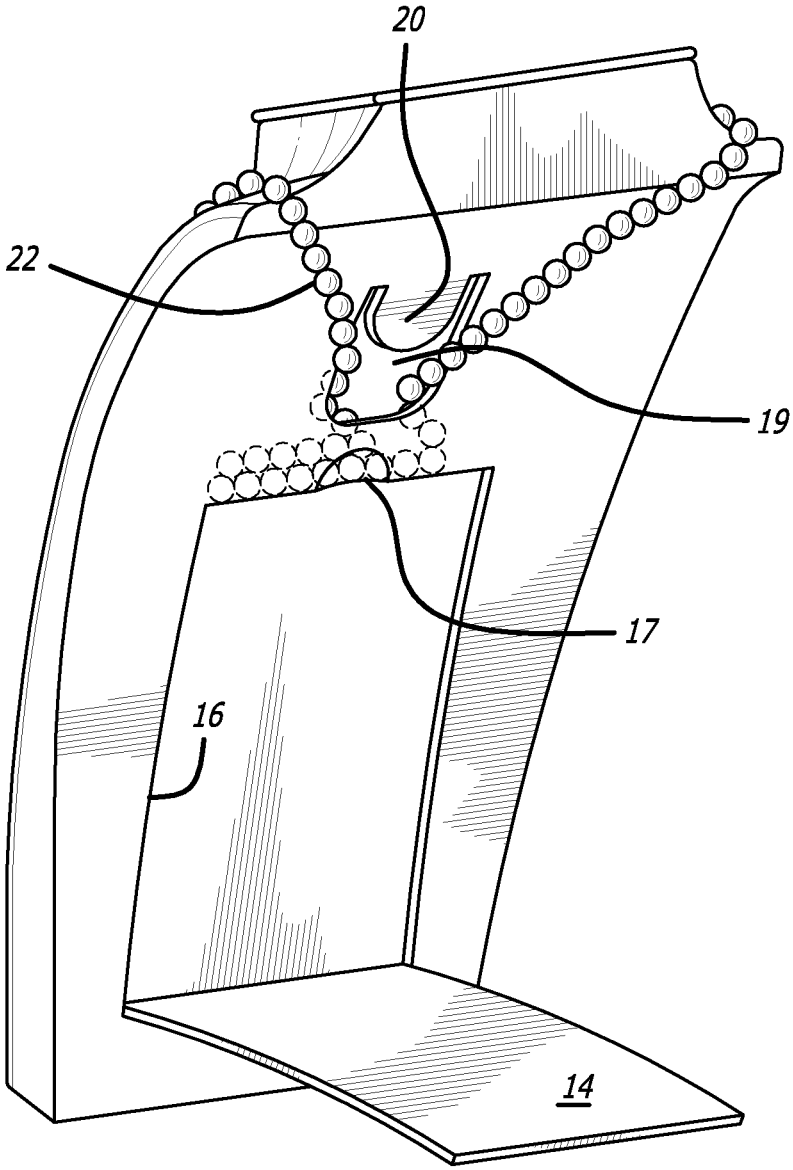
Figure 3:
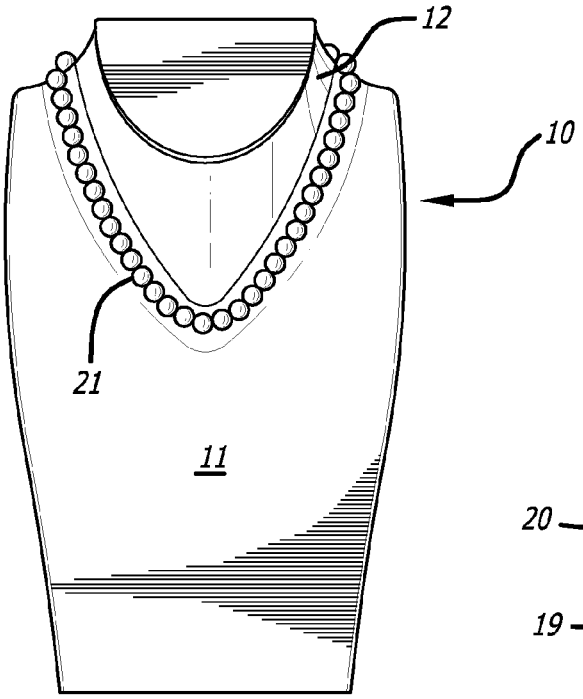
FIG. 3 is a front elevational view of the stand of FIGS. 1 and 2.
Figure 4A:
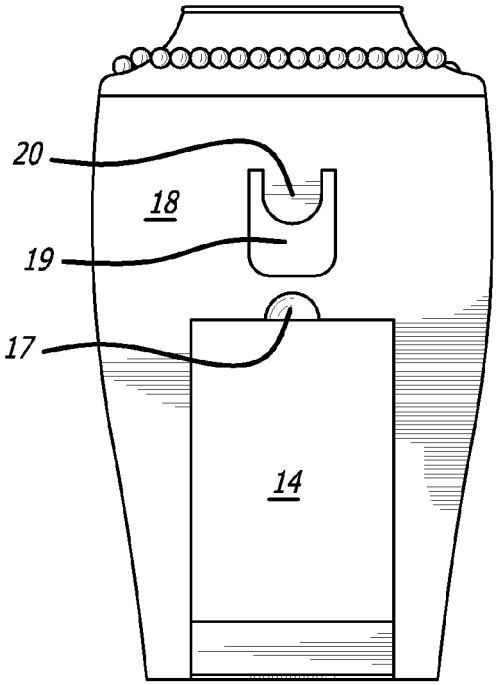
FIGS. 4A and 4B are rear elevational views with the support panel in stored position illustrating two ways of displaying a necklace on the stand of FIGS. 1 to 3.
Figure 4B:
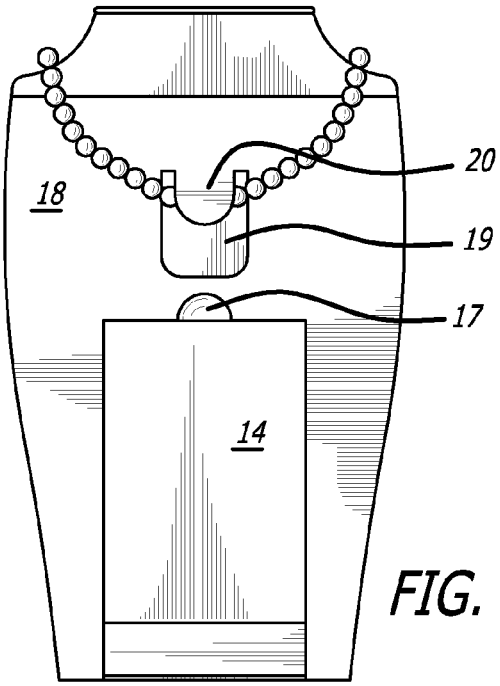

As seen in FIGS. 1 and 3, a necklace 21 can be draped over the upper portion of body portion 11 simulating a necklace draped around the neck of a person. See FIGS. 2A and 4A where the necklace 21 may be looped about the rear of neck portion 12. As seen in FIGS. 2B and 4B, if the necklace 21 is of a suitable length, the rear portion thereof can be hooked under tab 20 as shown. However, as seen in FIG. 2C, if the necklace is longer than the necklace 21 shown in FIGS. 2A and 2B, e.g., necklace 22, the surplus portion thereof can be inserted into the opening 19 down inside of the interior of body portion 11. This presents a pleasing appearance to display stand 10.

Figure 2D:
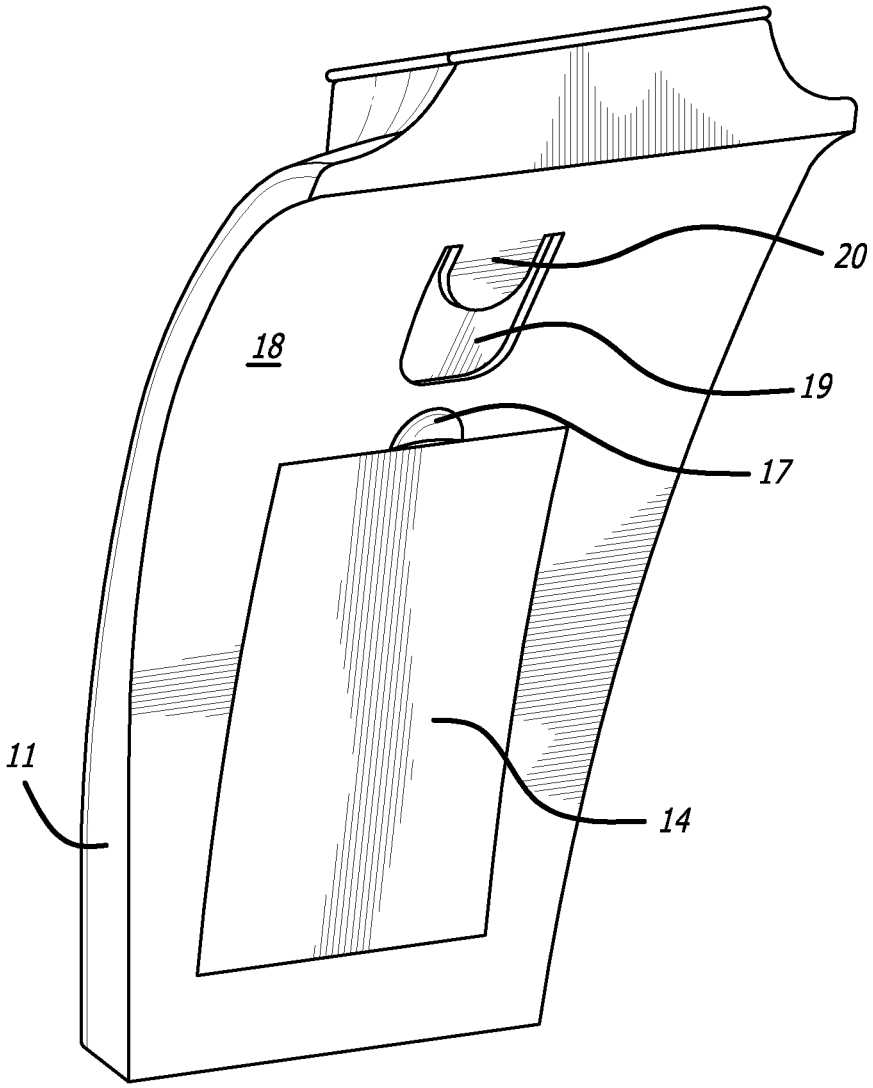
FIG. 2D is a view similar to FIG. 2C without the necklace and the support panel shown in stored position.

The stored position of support panel 14 is shown in FIG. 2D. FIG. 6 illustrates how the support panel 14 extends rearwardly of display stand 10. FIG. 6 illustrates, in dotted lines, how the support panel 14 is moved, as indicated by the arrow, into the stored position of FIGS. 2D, 4A and 4B.

One such hinging system is shown in detail in FIGS. 6A through 6E. A pair of elongated generally ovally shaped slots 23 (see FIG. 6E) are provided at the lower end of the inner walls of cavity 16. Panel 14 has a pair of pins 15, which may be round in cross section, on each side thereof at the rear of panel 14 adapted to ride within respective slots 23. Panel 14 is rounded at the rear conforming to the like configured U-shaped slots 24 at the lower end of cavity 16 as shown.

Figure 6A:
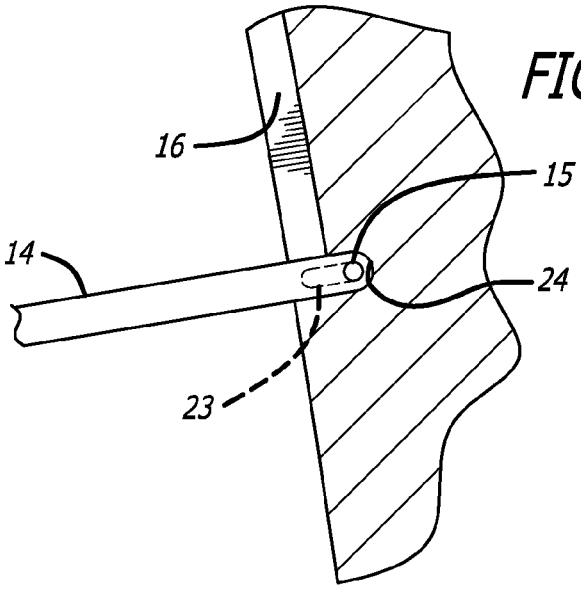
FIGS. 6A through 6E are detailed views of a portion of the stand of FIG. 6 illustrating hinging of the rear support panel.
Figure 6B:
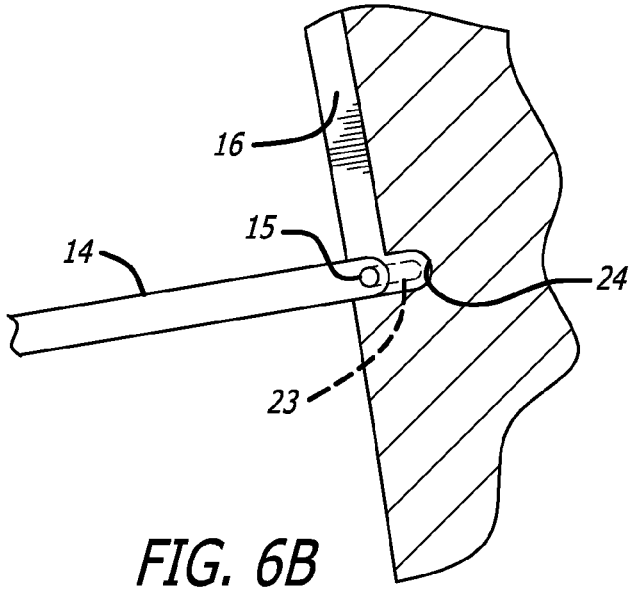
Figure 6C:
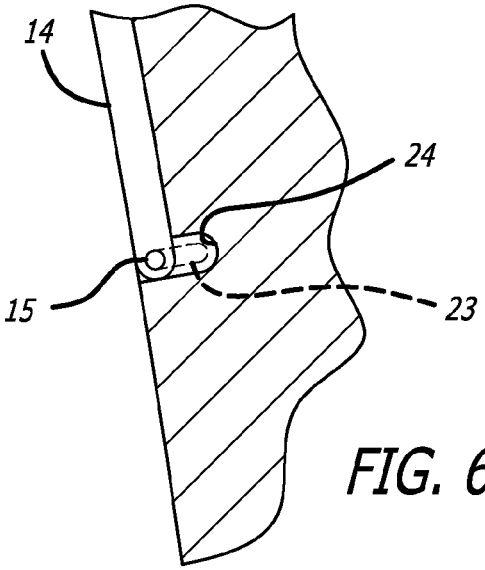
Figure 6D:
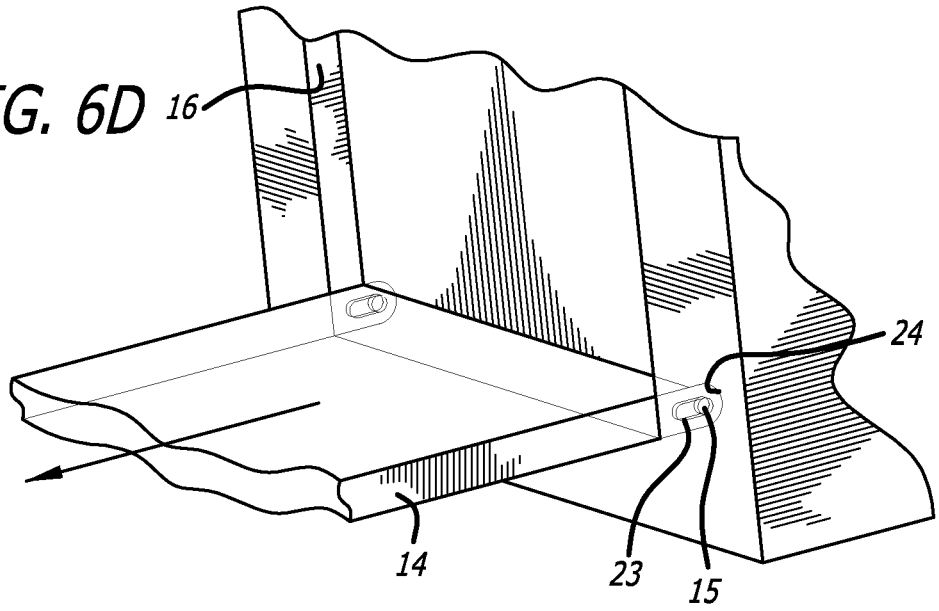
Figure 6E:
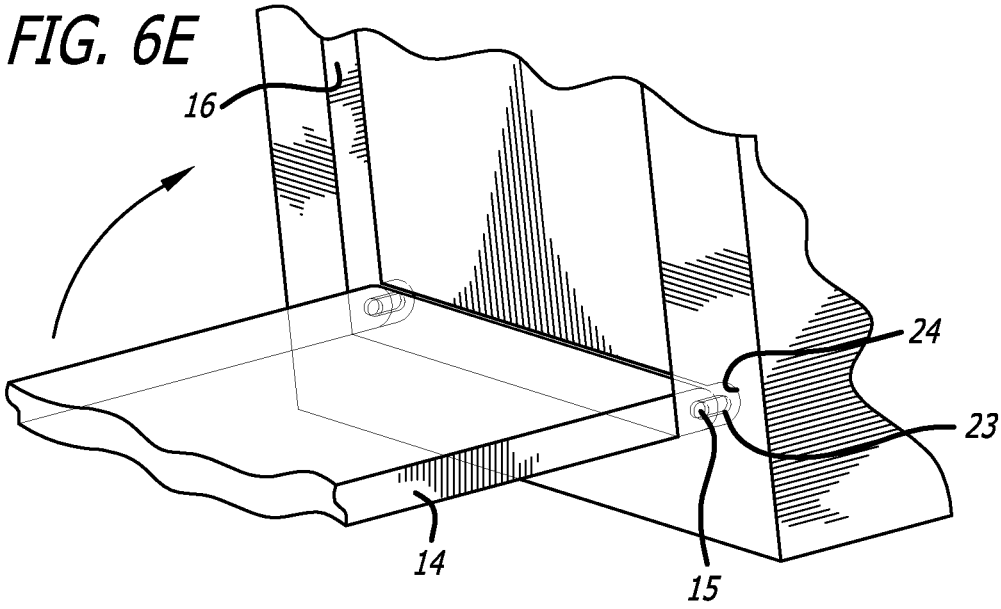

The initial position of panel 14 is shown in FIGS. 6A and 6E. Panel 14 is pulled out as shown in FIG. 6B and FIG. 6E, providing firm support, then moved up into cavity 16 as seen in FIG. 6C into the stored position. Thus, there is a firm support for the stand 10.

The display stand 10 may be of any suitable materials, such as lightweight plastic. The supporting panel can be hingedly secured and stored in any suitable manner.

Although a particular embodiment of the invention is disclosed, variations thereof may occur to an artisan and the scope of the invention should only be limited by the scope of the appended claims.

The invention claimed is:

1. A display stand for displaying an article of jewelry such as a necklace comprising:

a main body portion having a front wall simulating the upper torso of a person terminating at top in a simulated neck portion, and a rear wall;

a retractable support panel hingedly secured to the lower portion of the rear wall of said main body portion;

said main body portion being hollow on the interior;

an opening through the rear wall of said main body portion above said panel;

said rear wall having a recessed area receiving said panel therein for storage when said panel is moved from a support position to a stored position;

said panel having a lower end hingedly secured to the lower portion of the rear wall of said main body portion by a pair of outwardly extending spaced pins on opposite sides of the lower end of said panel movable in respective, elongated slots on opposite sides of said recessed area at the bottom thereof, wherein said panel moves from a first position providing the sole support for said stand hinging about said pins at the lower portion of said rear wall of said main body portion and movable to said storage position flush within said recessed area, said pins riding within said slots outwardly from said main body portion firmly locking said panel in said support position.

2. The stand of claim 1 including a tab integral with said rear wall overlying said opening whereby, when a necklace is draped about the front of said display stand, the end of said necklace extending about the rear wall of said display stand can be hooked under said tab.

3. The stand of claim 1 wherein said pins are round in cross-section and said slots are elongated ovals in configuration.

4. The stand of claim 1 wherein said stand is made from a light weight plastic material.

5. The stand of claim 1 including a necklace displayed on said stand, said necklace being disposed about the neck portion of said stand and hanging downwardly thereof on the front wall.

6. The stand of claim 5 wherein said neck portion has a rear portion and said necklace has a rear portion circled about the rear portion of said neck portion.

7. The stand of claim 5 wherein said necklace has a rear portion hooked under said tab.

8. The stand of claim 5 wherein said necklace has a rear portion disposed through said opening and into the interior of said main body portion.

9. A display stand for displaying an article of jewelry such as a necklace comprising:

a main body portion having a front wall simulating the upper torso of a person terminating at top in a simulated neck portion, and a rear wall;

a retractable support panel hingedly secured to the lower portion of the rear wall of said main body portion;

said main body portion being hollow on the interior;

said rear wall having a recessed area receiving said panel therein for storage when said panel is moved from a support position to a stored position;

said panel having a lower end hingedly secured to the lower portion of the rear wall of said main body portion by a pair of outwardly extending spaced pins on opposite sides of the lower end of said panel movable in respective, elongated slots on opposite sides of said recessed area at the bottom thereof, said panel providing the sole support for said stand when in the support position.

10. The display stand of claim 9 wherein an opening is provided through the rear wall of said main body portion above said panel.

11. The display stand of claim 10 including a tab integral with said rear wall overlying said opening whereby, when a necklace is draped about the front of said display stand, the end of said necklace extending about the rear wall of said display stand can be hooked under said tab.

* * * * *